US009363620B2

(12) United States Patent
Tsai

(10) Patent No.: US 9,363,620 B2
(45) Date of Patent: Jun. 7, 2016

(54) SYSTEM FOR CONTROLLING AUDIO FREQUENCIES OF ELECTRONIC APPLIANCES AND A METHOD OF THE SAME

(71) Applicant: BBPOS LIMITED, New Territory (CN)

(72) Inventor: Hwai Sian Tsai, Hong Kong (CN)

(73) Assignee: BBPOS LIMITED, New Territories, Hong Kong (CN)

( * ) Notice: Subject to any disclaimer, the term of this patent is extended or adjusted under 35 U.S.C. 154(b) by 413 days.

(21) Appl. No.: 13/845,396

(22) Filed: Mar. 18, 2013

(65) Prior Publication Data

US 2014/0016782 A1 Jan. 16, 2014

(30) Foreign Application Priority Data

Jul. 10, 2012 (CN) ..... 2012 1 0236699

(51) Int. Cl.

| | |
|---|---|
| ***H04S 7/00*** | (2006.01) |
| ***H04R 29/00*** | (2006.01) |
| *H04R 3/00* | (2006.01) |

(52) U.S. Cl.

CPC ..... *H04S 7/307* (2013.01); *H04R 29/00* (2013.01); *H04R 3/00* (2013.01); *H04R 2420/05* (2013.01)

(58) Field of Classification Search

None

See application file for complete search history.

(56) References Cited

U.S. PATENT DOCUMENTS

| | | | | |
|---|---|---|---|---|
| 8,150,046 | B2 * | 4/2012 | Hansson et al. | 381/58 |
| 8,917,882 | B2 * | 12/2014 | Miao | H04R 1/1041 381/123 |
| 2008/0137896 | A1 * | 6/2008 | Tsen | 381/370 |

* cited by examiner

*Primary Examiner* — Curtis Kuntz
*Assistant Examiner* — Kenny Truong

(57) ABSTRACT

The system comprises a master controller and an audio plug connected to the master controller. The audio plug includes at least four contacts electrically connected to corresponding poles of an audio frequency interface. Electrical coupling devices are disposed on circuits which respectively connect a first contact and a second contact with the master controller. The circuits between each electrical coupling devices and the correspondent contact are short circuits.

3 Claims, 5 Drawing Sheets

SYSTEM FOR CONTROLLING AUDIO FREQUENCIES OF ELECTRONIC APPLIANCES AND A METHOD OF THE SAME

FIELD OF THE INVENTION

The present invention relates to electronic appliances, especially to a system for controlling audio frequencies of electronic appliances and a method of the same that are adapted to different polarities of cellphones or Tablet PCs when they are connected.

DESCRIPTION OF THE RELATED ART

The 3.5 mm hands-free interface applied in the smartphone, the Tablet PC, the Internet Media Player, and the Video Game is not only served as an audio frequency interface but also served as a data transmission passage. For example, electronic appliances such as the Electronic Data Capture are able to connect to cellphones or computers via the passage.

Referring to FIGS. 1 to 3, there are two standards of the audio frequency interface 1 of the cellphone 100. One of the standards contains four terminals. According to an inserting direction, they are microphone input terminal 104, ground terminal 103, right sound channel output terminal 102, and left sound channel output terminal 101. The other standard contains the ground terminal 103, the microphone input terminal 104, the right sound channel output terminal 102, and the left sound channel output terminal 101. Obviously, the ground terminals 103 and the microphone terminals 104 are placed differently. In FIG. 2, one electronic appliance is provided with one standard audio frequency interface 1 in one cellphone. In FIG. 3, when an audio plug of the electronic appliance is inserted into a cellphone that is provided with the other audio frequency interface 1, the ground terminal and the microphone output terminal are unable to be coupled with the audio frequency interface 1. Evidently, it is inconvenient for people.

In order to settle afore inconvenience, a transforming circuit is provided. Herein, the transforming circuit in the electronic appliance automatically transforms polarities according to the inserting means of the audio plug of the cellphone when the audio frequency interface is connected. Therefore, the audio plug is adaptive to afore different audio frequency interfaces, which is more convenient. However, in practice, the transforming circuit complicates the circuit arrangement; the correlated cost is also increased, and the dimension of ended products is adversely bulky. Concurrently, the transforming circuit easily distorts and weakens output signals and input signals, which may result in unreliable communication.

Consequently, afore disadvantages should be amended.

SUMMARY OF THE INVENTION

The main object of the present invention is to provide a system for controlling audio frequencies of electronic appliances; the correlated structure and circuit are simple. When no transforming circuit is needed, a vacancy is reserved, which decreases manufacturing costs and is also more convenient.

A further object of the present invention is to provide a method for controlling audio frequencies of electronic appliances; the method is simple because no transforming circuit is needed while an audio plug of the electronic appliance is adaptive to audio frequency interfaces of two different standards.

The present invention is achieved as follows:

a system for controlling audio frequencies of electronic appliances comprises a master controller and an audio plug connected to the master controller; the audio plug includes at least four contacts electrically connected to corresponding poles of an audio frequency interface; the contacts are sequentially defined as a first contact, a second contact, a third contact, and a fourth contact according to an inserting direction of the audio plug; wherein, a plurality of resistors are correspondently disposed on circuits which respectively connect the first contact and the second contact with the master controller, the circuits between each resistor and the correspondent contact are short circuits, and the first contact and the second contact are controlled by the master controller as an audio frequency output module; one of the third contact and the fourth contact is a ground contact, and the other thereof is an audio frequency input contact.

A method for controlling audio frequencies of electronic appliances includes steps of: (1) preparing an audio plug of an electronic appliance which includes at least four contacts electrically connected to corresponding poles of an audio frequency interface; the contacts are sequentially defined as a first contact, a second contact, a third contact, and a fourth contact according to an inserting direction of the audio plug; (2) applying a master controller to define the first contact and the second contact as an audio frequency output module; a plurality of resistors are correspondently disposed on circuits which respectively connect the first contact and the second contact with the master controller, the circuits between each resistor and the correspondent contact are short circuits, so that an audio frequency input is conducted when an audio input pole of the audio frequency interface contacts with either the first contact or the second contact; and (3) defining one of the third contact and the fourth contact as a ground contact and the other thereof as an audio frequency input contact. Herein, some cellphone software controls and selects a zero potential output by a contact of the ground contact.

Accordingly, the present invention achieves effects as follows:

1. The structure and the circuit arrangement of the present invention are simpler since fewer parts are needed. Especially, a transforming circuit is exempted from the present invention, which reserves a vacancy and diminishes manufacturing costs. Preferably, it is more convenient.

2. An audio frequency input terminal is controlled as a zero potential for outputting. Thereafter, the ground terminal is parallelly connected to an audio frequency output terminal; accordingly, no matter the first contact or the second contact of the audio plug is contacted with an input pole of the audio frequency interface, an audio inputting is contributed. Thereby, the audio plug of the electronic appliance is adaptive to two different kinds of audio frequency interfaces. Favorably, the practical method is uncomplicated, and it is beneficial for promotion.

DETAILED DESCRIPTION OF THE PREFERRED EMBODIMENTS

Figure 4:
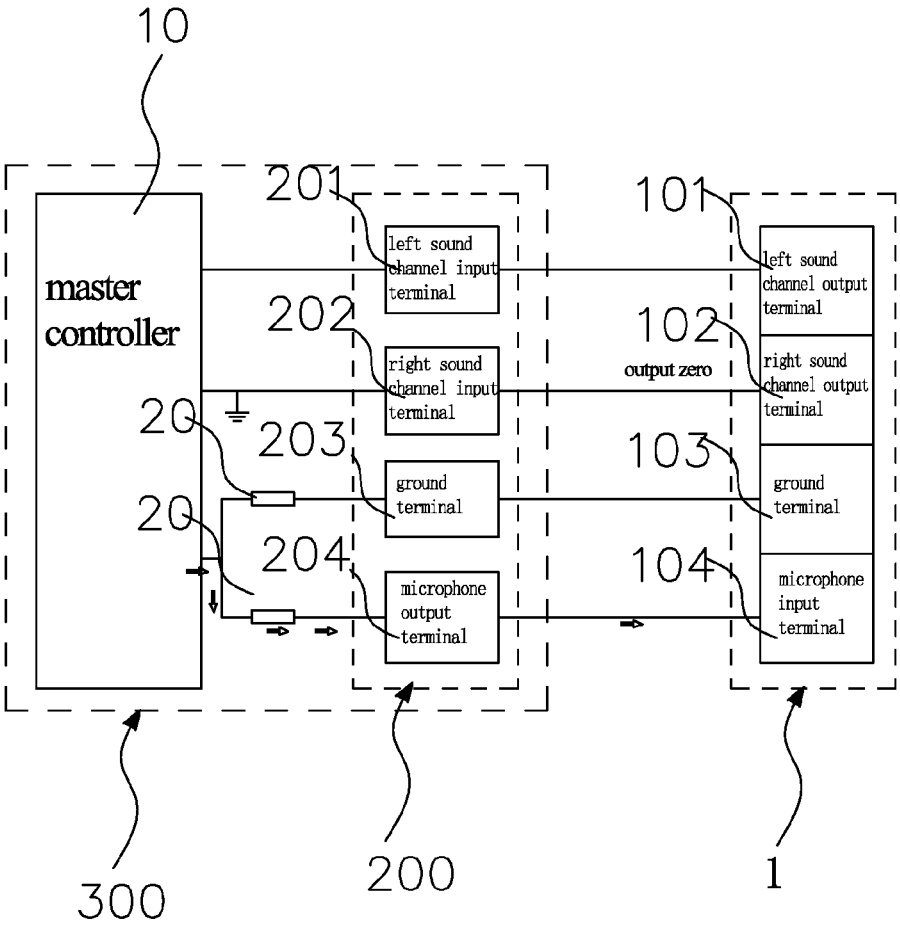
FIG. 4 is a frame chart showing an audio plug of an electronic appliance connected to a first standard audio frequency interface in the present invention.
Figure 5:
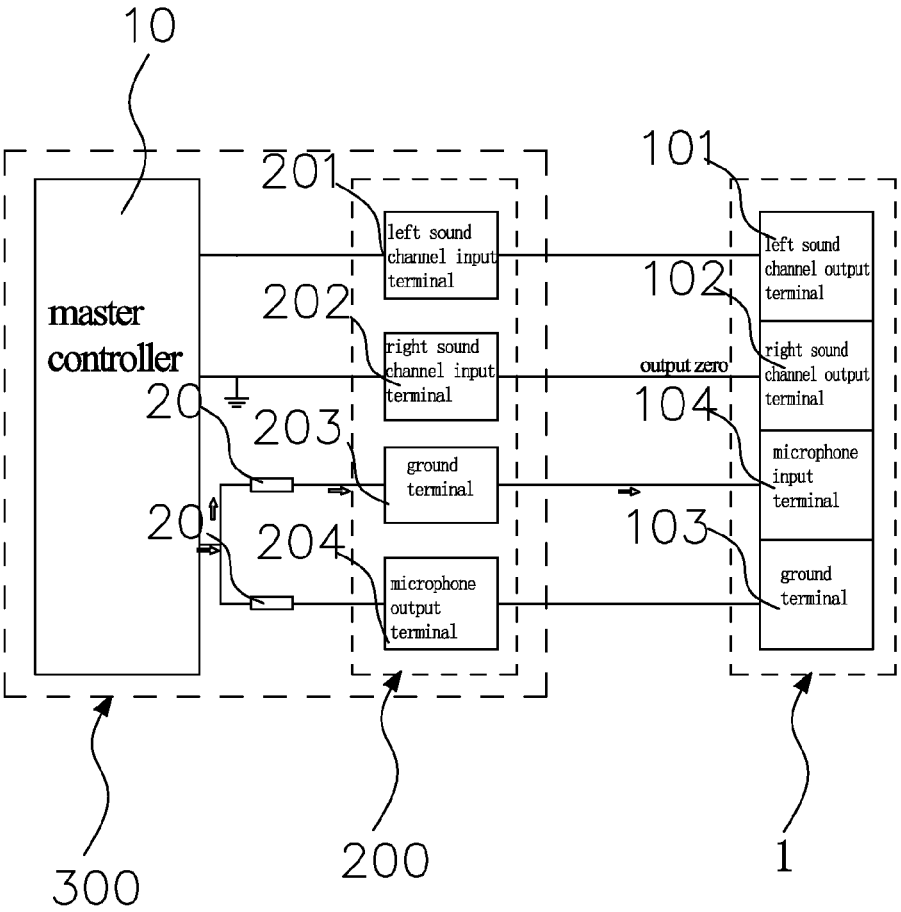
FIG. 5 is a frame chart showing an audio plug of an electronic appliance connected to a second standard audio frequency interface in the present invention.

Referring to FIGS. 4 and 5, a preferred embodiment of the present invention is shown. An electronic appliance indicated herein is a part of the other electronic appliance (such as a smartphone, a Tablet PC, an Internet Media Player, or a video game). The electronic appliance and the other electronic appliance are connected by an audio plug and an audio frequency interface so as to achieve communication therebetween.

Figure 1:
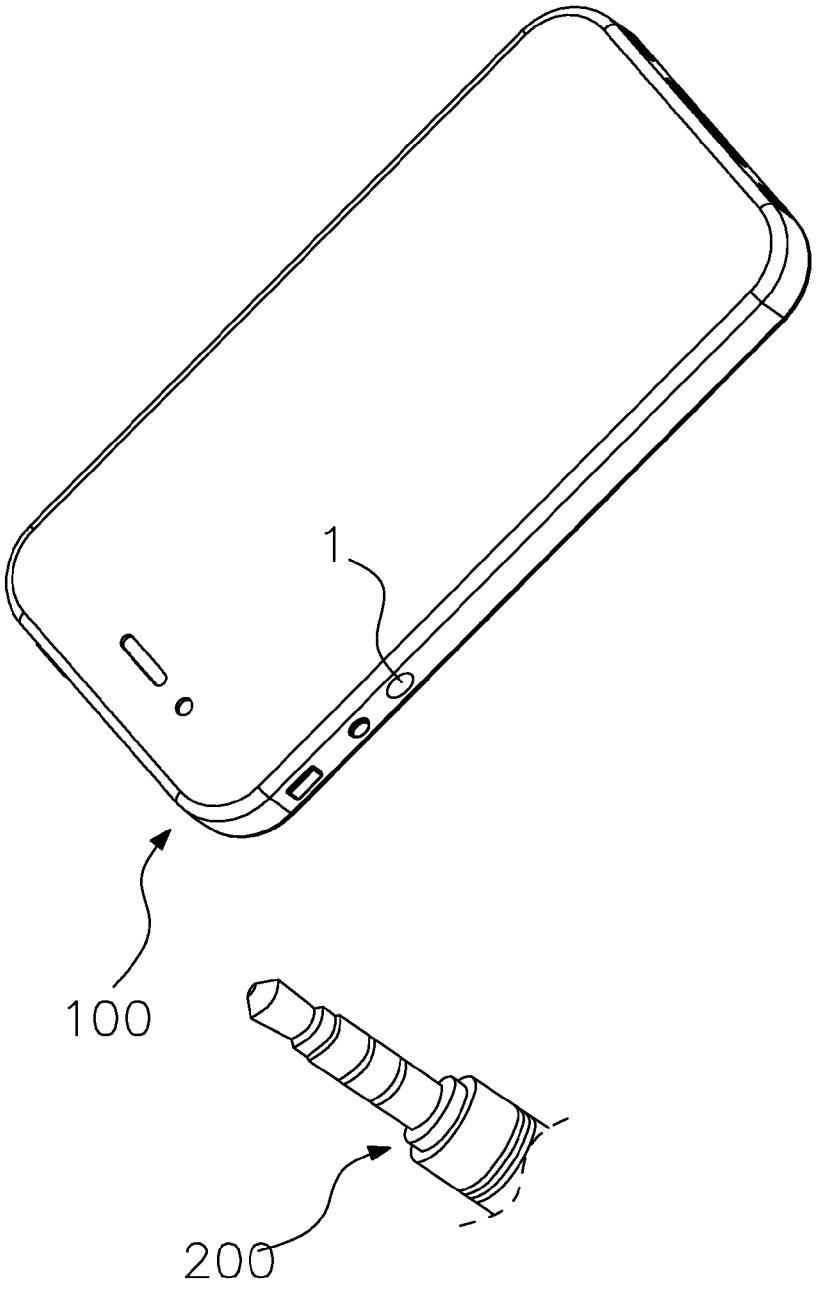
F I G. 1 Prior Art
FIG. 1 is a schematic view showing a conventional 3.5 mm audio plug (four-section type)
Figure 2:
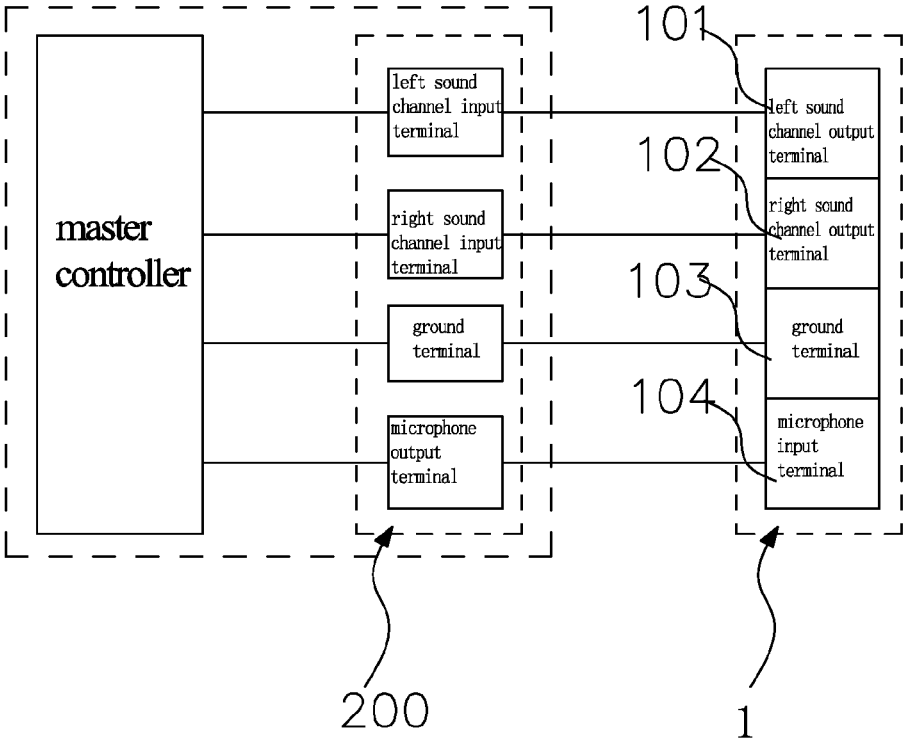
F I G. 2 Prior Art
FIG. 2 is a frame chart of a conventional first standard audio frequency interface.
Figure 3:
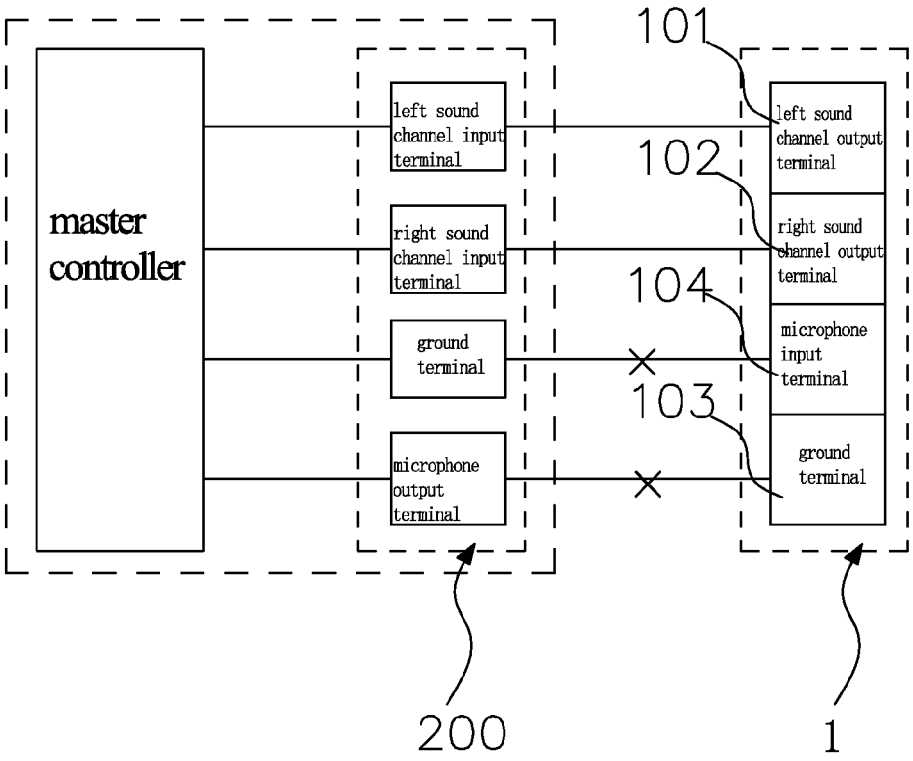
F I G. 3 Prior Art
FIG. 3 is a frame chart of a conventional second standard audio frequency interface.

In FIG. 1 to FIG. 3, the single audio plug 200 is unadaptable to two different kinds of standard audio frequency interfaces 1. The audio frequency interface 1 of the cellphone 100 in this embodiment is adopted in the audio frequency interface coupled to the audio plug 200 shown in FIGS. 1 to 5. The audio frequency interface 1 is a 3.5 mm standard audio frequency interface. Besides being served as an audio frequency interface, the audio frequency interface is also served as a data transmission passage. For example, an electronic data capture is able to connect to a cellphone or a computer via afore passage.

A system 300 for controlling audio frequencies of an electronic appliance of the present invention comprises a master controller 10 (composed of a micro CPU or a customized chip), and an audio plug 200 connected to the master controller 10. The audio plug 200 includes at least four contacts electrically connected to corresponding poles of the audio frequency interface 1. According to an inserting direction of the audio plug 200, the contacts are sequentially defined as a first contact, a second contact, a third contact, and a fourth contact. Wherein, a plurality of resistors 20 are correspondently disposed on circuits which respectively connect the first contact and the second contact with the master controller 10. The circuits between each resistor 20 and the correspondent contact are short circuits, and the first contact and the second contact are controlled by the master controller 10 as an audio frequency output module. One of the third contact and the fourth contact is a ground contact, and the other thereof is an audio frequency input contact. The cellphone or the Tablet PC connected to the audio plug is controlled to output zero potential to the ground contact, which allows the electronic appliance to acquire a requisite zero potential reference without having any relationship with contacting means of the first contact and the second contact.

In FIG. 4, according to an inserting direction, the four contacts are microphone output terminal 204, ground terminal 203, right sound channel input terminal 202, and left sound channel input terminal 201. In the audio frequency interface 1, the correspondent poles are microphone input terminal 104, ground terminal 103, right sound channel output terminal 102, and left sound channel output terminal 101. In FIG. 5, in the audio frequency interface 1, the correspondent poles are ground terminal 103, microphone input terminal 104, right sound channel output terminal 102, and left sound channel output terminal 101. When the zero potential is output via the left sound channel output terminal 101 or the right sound channel output terminal 102 controlled by software in the cellphone or the Tablet PC, the correspondent left sound channel input terminal 201 or the right sound channel input terminal 202 is served as a ground contact. When the right sound channel output terminal 102 or the left sound channel output terminal 101 in the audio frequency interface of the cellphone or the Tablet PC is controlled by the cellphone or the Tablet PC as an audio frequency for outputting, the correspondent right sound channel input terminal 202 or the left sound channel input terminal 201 is served as an input contact of signals from the cellphone or the Tablet PC to the controller. The ground terminal 203 and the microphone output terminal 204 are connected to the audio frequency output module of the master controller 10 in the electronic appliance. Therefore, no matter the structure in FIG. 4 or the structure in FIG. 5 is adopted by the audio frequency interface 1, the ground terminal 203 and the microphone output terminal 204 are connected to the audio frequency output module of the master controller 10 in the electronic appliance 300. Thereby, no matter the audio frequency input pole of the audio frequency interface 1 is contacted with the ground terminal 203 or the microphone output terminal 204 of the audio plug 200, an audio frequency input is contributed. Namely, the electronic appliance 300 provided with the system for controlling audio frequencies is able to be coupled to afore two different kinds of audio frequency interfaces 1. Preferably, no extra part is needed, and no complicated operation is required.

To sum up, the structure and the circuit of the present invention are simpler, which also reserves vacancies and saves costs. Preferably, signals that are output or input do not weaken and distort; the communication is more reliable. The audio frequency input terminal in the conventional technique is served as the ground terminal, and the correspondent audio frequency of the audio frequency interface outputs the pole for outputting the zero potential, so that the ground terminal achieves the zero potential reference. Moreover, the ground terminal and the audio frequency output terminal in the conventional technique are parallelly connected. Thus, no matter the audio frequency output pole of the audio frequency interface is connected to the first contact or the second contact of the audio plug, the audio frequency input is contributed. As a result, the audio plug of the electronic appliance is suited to two different kinds of audio frequency interfaces; the operating means is easy, and it is beneficial for promotion.

I claim:

1. A system controlling audio frequencies of electronic appliances (300) in the absence of transforming circuits, in adapting in polarities to different audio frequency interfaces (1) of portable electronic devices including cell phones (100), tablets, internet media players, with the interfaces (1) including M, G, R and L in two standards:

standard 1, characterized by the G laid out in between the M and the R, and standard 2, characterized by the M laid out in between the G and the R, wherein M denoting a microphone input terminal (104), G, a ground terminal (103), R, a right sound channel output terminal (102), and L, a left sound channel output terminal (101);

the system, dispensing with the transforming circuits in adaptation on the polarities of the interfaces (1) by grounding one of four contacts I-IV of an audio plug (200), comprising:

the plug (200) with the four contacts, connected to the interface (1); and the controller (10), composed of a micro CPU and connected to the plug (200) to control the four contacts i) by setting the contact I or II as an output for the interfaces (1), the contact I and II are each connected to the controller (10) via resistors (20) disposed on a circuit I and a circuit II, respectively, and the circuit I and II are parallelly connected; and ii) setting the contact III or IV as a ground terminal connected to the R of the interfaces (1) such that when the contact III is set grounded, the contact IV is set for input, and vice versa.

2. The system controlling audio frequencies of electronic appliances (300) in the absence of transforming circuits as claimed in claim 1, wherein a first embodiment of the plug (200) realized by the controller (10) is adaptation to the interfaces (1) of the standard 1 includes 1) a microphone output terminal (204) as the contact I, connected to the M of the standard 1 of the interfaces (1) to output signals to the M,
2) a ground terminal (203) as the contact II, connected to the G,
3) a right sound channel input terminal (202) as the contact III, grounded and connected to the R for the R to output a zero potential, and
4) a left sound channel input terminal (201) as the contact IV, connected to the L to receive an input from the L.

3. The system controlling audio frequencies of electronic appliances (300) in the absence of transforming circuits as claimed in claim 1, wherein a second embodiment of the plug (200) realized by the controller (10) in adaptation to the interfaces (1) of the standard 2, is characterized by i) including the same terminals (204, 203, 202, and 201) disposed in the same sequential order as that of the first embodiment; but
ii) using the ground terminal (203) to output the signals to the M.

* * * * *